United States Patent [19]

Yabe et al.

[11] Patent Number: 4,510,413

[45] Date of Patent: Apr. 9, 1985

[54] ELECTRODE STRUCTURE FOR ELECTRON GUN

[75] Inventors: Minoru Yabe; Kenichi Noda; Satoru Endo, all of Mobara; Masaaki Yamauchi, Tohgane, all of Japan

[73] Assignee: Hitachi, Ltd., Tokyo, Japan

[21] Appl. No.: 214,693

[22] Filed: Feb. 9, 1980

[30] Foreign Application Priority Data

Jan. 18, 1980 [JP] Japan ..... 55-3471

[51] Int. Cl.[3] ..... H01J 29/46

[52] U.S. Cl. ..... 313/460; 313/409

[58] Field of Search ..... 313/411, 414, 460, 412, 313/409, 417

[56] References Cited

U.S. PATENT DOCUMENTS 4,063,128 12/1977 Hughes ..... 313/417 X
4,232,246 11/1980 Sakurai et al. ..... 313/414

FOREIGN PATENT DOCUMENTS 52-70747 6/1977 Japan ..... 313/409
5469379 11/1977 Japan ..... 313/411

*Primary Examiner*—David K. Moore
*Attorney, Agent, or Firm*—Antonelli, Terry & Wands

[57] ABSTRACT

An electrode structure for an electron gun, especially an in-line type electrode structure for an electron gun of a color picture tube. The electrode structure dispenses with auxiliary electrodes and its three cylindrical members are integrally formed by press work. After the pressing step, the inner edge of the bottom portion of each cylindrical members is beveled to provide a tapering surface having a desired circular cross section. By forming a circular groove in the bottom portion, opposite to the tapering surface, the formation of the tapering surface is made more exact.

15 Claims, 21 Drawing Figures

ELECTRODE STRUCTURE FOR ELECTRON GUN

This invention relates to an electrode structure for an electron gun, and more particularly to the electrode structure of a main lens for an electron gun used especially in a color picture tube.

As is well known, electron guns used in a color picture tube may be of the in-line arrangement or the delta arrangement. This invention can be applied to both types of the structures, but in the following description the application of this invention to the in-line type electron gun will be used as a primary example.

The electrode structure of a conventional in-line type electron gun comprises a cathode for emitting electron beams, a first grid for controlling the electrons, a second grid for accelerating the electron beams, and third and fourth grids constituting main lenses for the electron beams. The third and the fourth grids respectively have three cylindrical lens sections arranged in the in-line configuration and cylindrical auxiliary electrodes concentrically fixed to the lens sections. These auxiliary electrodes serve to provide desired focusing characteristics.

However, the electron gun having such a structure as described above needs numerous steps of fabrication and comprises very many parts. Further, the measurement of the eccentricity of each cylindrical lens section is difficult.

One object of this invention is to provide a novel electrode structure for an electron gun, which is completely free from the above drawbacks.

Another object of this invention is to provide an electrode structure for an electron gun, in which no auxiliary electrode is used.

Still another object of this invention is to provide an electrode structure for an electrode gun, in which no auxiliary electrode is used and which has cylindrical members with their free ends having desired eccentricities.

According to this invention, there is provided an electrode structure for an electron gun having three cylindrical members integrally formed and arranged near to one another, wherein the internal edge of each cylindrical member at the bottom thereof is beveled to provide a tapering surface having a desired eccentricity.

These and other objects, features and advantages of this invention will be more apparent from the following descriptions tkaen in conjunction with the accompanying drawings, in which.

Figure 12:
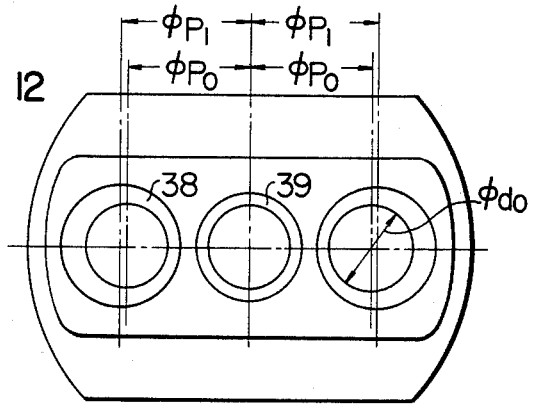
Figure 13:
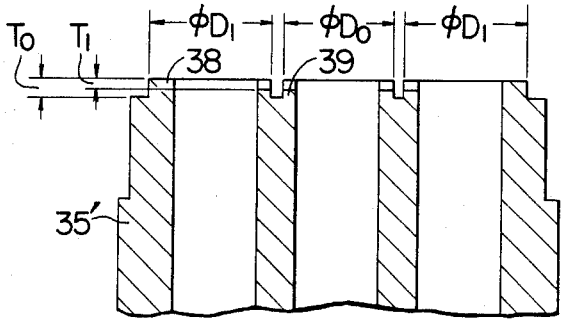
Figure 14:
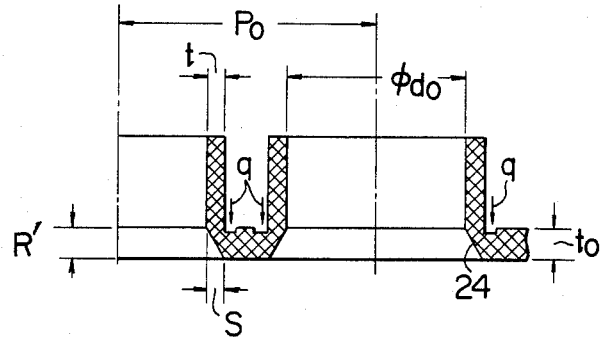

FIG. 12 and FIG. 13 respectively show the plan and the cross section of a shaping die for forming annular grooves;

FIG. 14 shows in cross section the main part of the electrode structure, illustrating how to determine the dimensions of the tapering surfaces at the bottoms of the cylindrical parts.

Before the description of various embodiments of this invention is provided, a conventional electrode structure for an electron gun will be explained for a better understanding of this invention.

Figure 1:
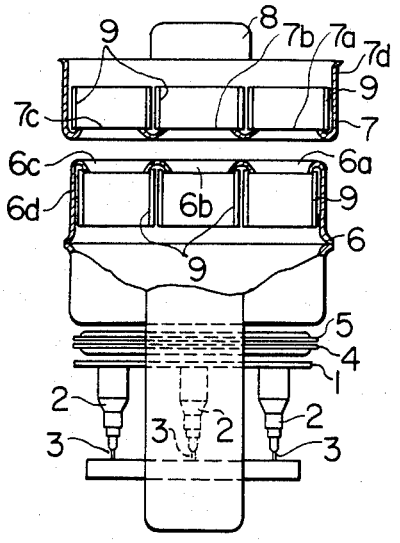
FIG. 1 PRIOR ART
FIG. 1 shows in side view with a partial cross section, a conventional in-line type electron gun.

In FIG. 1 showing the electrode structure of a conventional in-line type electron gun, a flat plate as a cathode supporting member 1 rigidly supports three cathodes 2 arranged in a row and the cathodes 2 are heated by heaters 3 inserted through the cathodes 2 so as to emit electron beams. In front of the cathodes 2, first grid 4, second grid 5 and third and fourth grids 6 and 7 are disposed and fixed to a bead glass 8.

The third and fourth grids 6 and 7, which serve as main lens electrodes, respectively, have three cylindrical lens sections 6*a*, 6*b* and 6*c* and three cylindrical lens sections 7*a*, 7*b* and 7*c* arranged close to one another. Cylindrical auxiliary electrodes 9 are coaxially inserted in these lens sections and fixed to the same. These auxiliary electrodes 9 are so provided as to prevent the electric fields established in the third and fourth grids 6 and 7 from being affected by the influence of the side walls 6*d* and 7*d* of the third and fourth grids 6 and 7. Therefore, the electrodes 9 may be omitted if the cylindrical body of each of the lens sections 6*a*–6*c* and 7*a*–7*c* is formed so as to be long enough.

Figure 2:
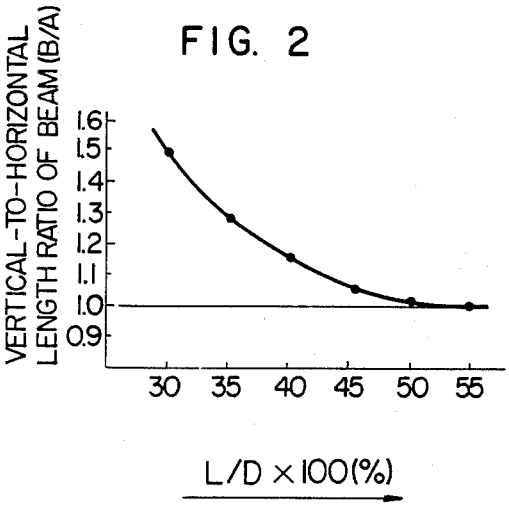
FIG. 2 shows the relationship between the height of the auxiliary electrode and the focus characteristic, of an electrode structure for a conventional electron gun.

FIG. 2 shows the relationship between the length of each lens section and the focusing characteristic in the picture center of a color picture tube. The main lens electrode used for this plotting was fabricated by the machine cutting of non-magnetic stainless steel, which is used as the material for an actual main lens electrode, although it is usually formed by press working. The length of each of the lens sections 6*a*–6*c* and 7*a*–7*c* was discretely changed. The abscissa represents the ratio L/D in percentage of the length L of the lens section to the inner diameter D of the lens section and the ordinate gives the ratio of the vertical length B to the horizontal length A, of a beam spot in the picture center of a color picture tube, i.e. vertical-to-horizontal length ratio B/A of beam. As apparent from FIG. 2, the ideal condition is reached when the vertical-to-horizontal ratio B/A of the beam is 1.0, that is, when the beam spot is a complete circle. In general, however, it is considered that the focussing characteristic of a color picture tube remains the same if the ratio deviates from 1.0 within a range of +5%, that is, if the ratio lies in a range of 0.95–1.05. The eliminate the auxiliary electrodes 9 by satisfying the above requirement, it is necessary to make the ratio L/D greater than about 50%, as is apparent from FIG. 2.

Figure 3A:
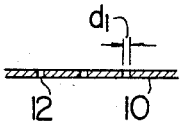
FIGS. 3A to 3E illustrate the steps of a method for fabricating lens sections in an electrode structure for an in-line type electron gun.
Figure 3B:
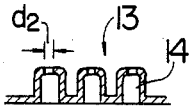
Figure 3C:
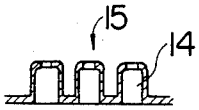
Figure 3D:
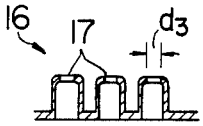
Figure 3E:
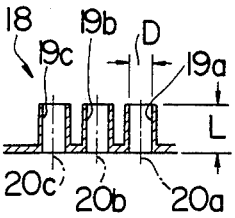
Figure 4A:
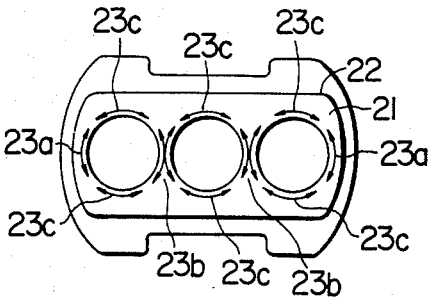
FIGS. 4A to 4C are respectively a plan, a lateral section and a longitudinal section of the electrode structure fabricated by the method shown in FIGS. 3A to 3E.
Figure 4C:
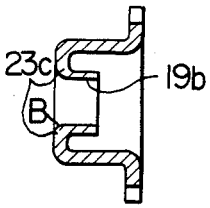
Figure 4B:
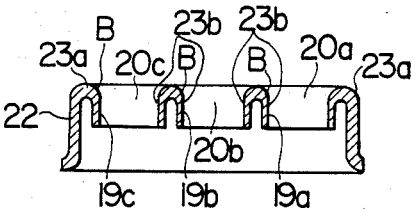

Accordingly, the present inventor has proposed a method as shown in FIGS. 3A to 3E according to which a main lens electrode is fabricated by integrally forming three lens sections each having a long cylindrical portion whose L/D is greater than 50%. First, holes 12 having a desired diameter $d_1$ are cut in a base plate 10 through punching, as shown in FIG. 3A. Then, embossed portions 14 are formed through embossing work 13, as shown in FIG. 3B. In this embossing step, the holes 12 are expanded and come to have a larger diameter $d_2$ than $d_1$. This provides an auxiliary function of improving the height of the embossed portion 14. Next, the side walls of the embossed portions 14 are subjected to squeeze-embossing work 15 to further increase the heights of the embossed portions 14. This squeeze-embossing work 15 comprises plural steps in which the outer diameter of a punch is gradually increased while the inner diameter of the associated die is kept constant, that is, the gap between the die and the punch is gradually decreased. As shown in FIG. 3D, holes 17 for burring, having a diameter of $d_3$ are cut through punching work 16. Finally, as shown in FIG. 3E, lens sections 20*a*, 20*b* and 20*c* having cylindrical portions 19*a*, 19*b* and 19*c* are formed through burring. As a result of the above process, the ratio L/D can be made greater than 50%. The thus completed lens electrode is shown in FIG. 4.

However, according to the above process, since intensive plastic shaping works, such as embossing and squeezing, are performed, the wall thickness of the cylindrical portions 19*a*–19*c* decrease at their bottom portions B (curvature R) which extend integrally from the top plate 21 (base plate 10). And, the degrees of decrease in the wall thicknesses of the cylindrical portions 19*a*–19*c* in their regions 23*a* near the cap 22, in their regions 23*b* between them and in their remaining regions 23*c*, are different so that the corresponding amplitudes of strain in these regions 23*a*–23*c* are different. Namely, the bottom portion of each of the cylindrical members 19*a*–19*c* has different strains due to plastic working in the circumferential regions 23*a*, 23*b* and 23*c* and therefore has an uneven distribution of thickness along its circumferential direction. Especially, the thickness in the region 23*b* between the cylindrical portions is decreased to the greatest extent since metal flow is caused during embossing and squeezing in the axial direction of the cylinder. The next greatest decrease in thickness occurs in the region 23*a* which carries squeezing load in the formation of an elliptical cap 22 by squeezing work. It therefore follows that the thickness of the region 23*c* > the thickness of the region 23*a* > the thickness of the region 23*b*.

Figure 5:
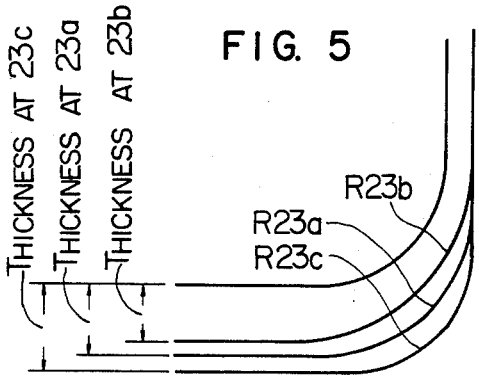
FIG. 5 shows the wall thicknesses of the cylindrical portions at the bottoms thereof.

This unevenness in the wall thickness at the bottom portion of each cylindrical member along its circumferential direction leads to the unevenness in the curvature R at the bottom portion of each cylindrical member along its circumferential direction, as shown in FIG. 5. Namely, the region 23*b* has the least curvature. This leads next to the tendency of the cross section of the bottom portion deviating from a true circle and therefore the completed electron lens assumes a distorted oblong shape so that the the focusing characteristic is degraded and the main lens electrode can no longer perform its proper function. According to this process of fabrication, although the ratio L/D can be made greater than 50%, the focusing characteristic is too poor for practical application so that auxiliary electrodes 9 must be incorporated for actual use.

Figure 6A:
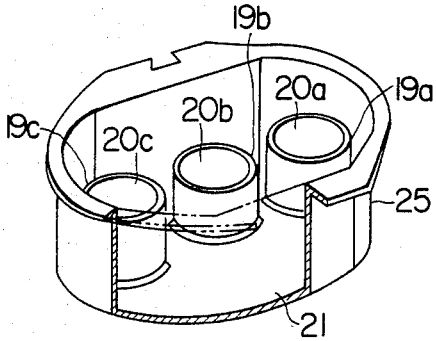
FIG. 6A shows in a perspective view an electrode structure for an electron gun as an embodiment of this invention.
Figure 6B:
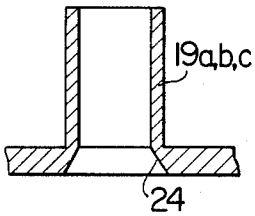
FIG. 6B shows in cross section the main part of the electrode structure shown in FIG. 6A.
Figure 7:
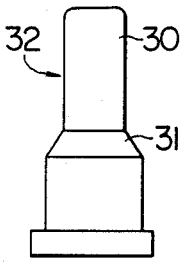
FIG. 7 is an external view of a mandrel.
Figure 8:
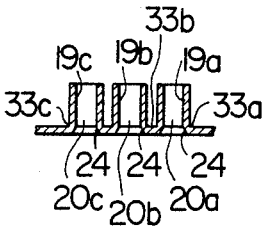
FIG. 8 shows in cross section an electrode structure obtained according to this invention.
Figure 9:
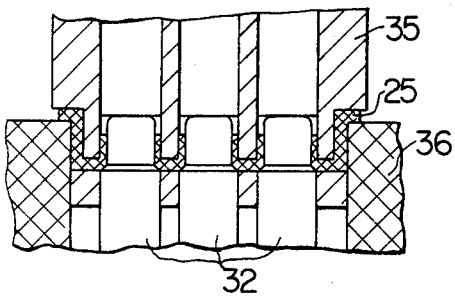
FIG. 9 shows in cross section a completed electrode structure and the metal mold for shaping the electrode.

Now, this invention will be described by way of an exemplary embodiment with the aid of the attached drawings. FIGS. 6A and 6B respectively show in a perspective view and in the cross section of the main part an electrode structure for an electron gun as an embodiment of this invention. In these figures, like or equivalent parts are indicated by the same reference numerals as in FIGS. 4A to 4C and the description of the previously mentioned parts is omitted. According to this invention, an electrode structure is fabricated by the process shown in FIGS. 3A to 3E, in which the ratio L/D of the height L to the inner diameter D, of each of the cylindrical portions 19*a*–19*c* is made equal to or greater than 0.5, and then the edge of the bottom portion B of each cylindrical member is beveled to provide a tapering surface 24 whose cross section perpendicular to the axis of the cylindrical member gives a true circle. The tapering surface 24 is formed by subjecting the bottom portion to pressing work after the step shown in FIG. 3E by using a mandrel 32 having a guide portion 30 to be inserted in each of the cylindrical portions 19*a*–19*c* and a tapering portion 31 for forming the tapering surface 24. FIG. 8 shows an electrode structure after such a tapering work. FIG. 9 shows the electrode structure shown in FIG. 8 together with metal moldings used to form the structure. In FIG. 9, numeral 35 designates a die, and 36 a bottom mold for guiding an electrode 25 embodying this invention. After the tapering work, the inner edges of the bottom portions of the cylindrical members, which have different curvatures, are changed to a shape corresponding to that of the tapering portion 31 of the mandrel 32. Namely, the application of pressure to the inner edges of the bottom portions by the tapering portion 31 of the mandrel 32 causes metal flow in the bottom regions to form tapering surface 24 with a desired circular cross section. The tapering surface 24, i.e. conic surface, need not have a generatrix of a straight line, but the generatrix may be in any shape that provides a desired circular cross section. For example, the tapering surface may be replaced by a rotated-ogive surface, a rotated-cusp surface or a counter-shaped surface.

Next, another embodiment of this invention will be explained in which the tapering surface can be more easily and more exactly formed. The gist of this is to form circular grooves in the outer bottom portions 33*a*, 33*b* and 33*c* of the cylindrical members 19*a*–19*c* before the tapering work.

Figure 10:
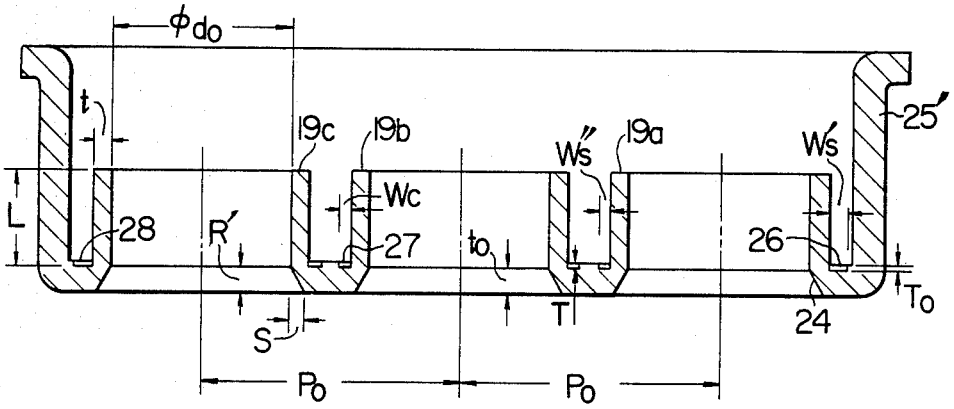
FIG. 10 shows in cross section an electrode structure for an electron gun as another embodiment of this invention.
Figure 11:
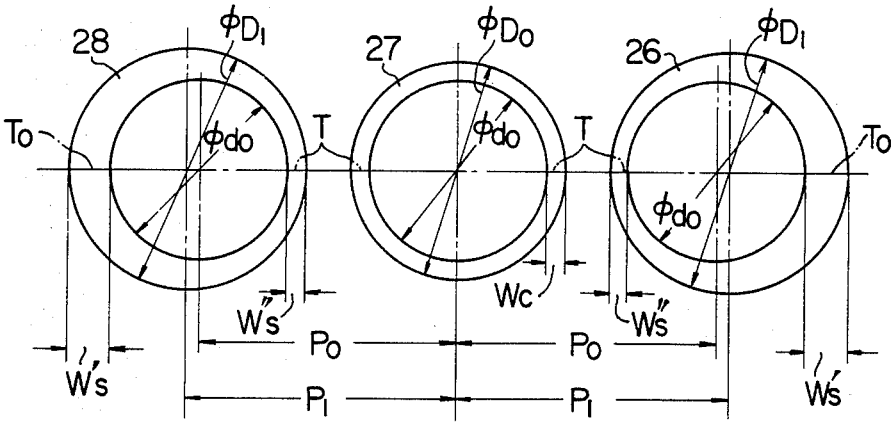
FIG. 11 illustrates the dimensions of the annular grooves in the electrode structure shown in FIG. 10.

FIG. 10 shows in cross section an electrode having circular grooves embodying this invention. In FIG. 10, numeral 25' designates an electrode having circular grooves embodying this invention, and 26, 27 and 28 indicate circular grooves cut respectively around the cylindrical portions 19*a*, 19*b* and 19*c*. The width and the depth of each of the circular grooves 26 and 28 are not uniform along the length of the groove. The width and the depth of each of the grooves 26 and 28 are smaller in the region near the cylindrical member 19*b* than in the remaining region. FIG. 11 shows these circumstances. The width and the depth of the circular groove 27 around the middle cylindrical member 19*b* are uniform along its length and the width Wc is given by the expression:

$$Wc=(D_0-d_0)/2 \quad (1),$$

where $D_0$ and $d_0$ are respectively the outer and inner diameters of the circular groove 27. The depth T of the groove 27 is also constant along its length. The width of each of the grooves 26 and 28 is not uniform along its length and varies from the smallest width Ws'' at the innermost region to the greatest width Ws' at the outermost region. The greatest and the smallest widths Ws' and Ws'' are expressed as follows.

$$Ws'=(D_1-d_0)/2+(P_1-P_0) \quad (2)$$

$$Ws''=(D_1-d_0)/2-(P_1-P_0) \quad (3),$$

where $D_1$ is the outer diameter of the groove 26 or 28, $P_1$ is the distance between the center of the circular groove 27 and the center of the outer diameter of the groove 26 or 28, and $P_0$ is the distance between the centers of the adjacent cylindrical members 26 and 27, or 27 and 28. In this embodiment, the width and the depth of each of the circular grooves 26 and 28 are smallest, i.e. Ws'' and T, in the region nearest to the cylindrical member **19*b* and they gradually increase, with the distance from the member 19*b***, up to the values Ws' and $T_0$ at the outermost region. Preferably, it is necessary that Ws''=Wc. This relation gives, with the aid of the expressions (1) and (3), the expression:

$$(D_1-D_0)/2=P_1-P_0 \quad (4).$$

As described with FIG. 5, the wall thickness of the bottom portion of each cylindrical member varies along the circumferential direction (i.e. in the regions **23*a*, 23*b* and 23*c***). The metal flow occurring in the bottom portion in the tapering work must be controlled to a small extent in the thinner portion and to a greater extent in the thicker portion. The degree of the metal flow can be made small or large accordingly as the width and the depth of each circular groove are rendered small or large. Accordingly, by suitably changing the width and the depth of each groove, the metal flow can be so controlled as to compensate for the unevenness in the wall thickness of the bottom portion of each cylindrical member, whereby a tapering surface having a desired circular cross section can be more exactly formed.

FIGS. 12 and 13 are respectively the plan and the cross section of a shaping die 35' having projections 38 and 39 for forming the circular grooves 26, 27 and 28. The metal flow occurring in the tapering work will be effectively controlled by the projections 38 and 39. As shown in FIG. 12, the width and the dpeth of the projection 38, corresponding to those of the grooves 26 and 28, are not uniform, while those of the projection 39 are uniform along the circumferential direction. In this embodiment, the depths $T_0$ and $T_1$ are respectively 0.1 mm and 0.05 mm.

FIG. 14 shows in cross section the details of an electrode with circular grooves embodying this invention. S is the width of the tapering surface 24, R' is the height of the tapering surface 24, t is the wall thickness of the cylindrical portion, and $t_0$ is the thickness of the electrode 25. In order to facilitate the uniform formation of the tapering surface by the pressure applied in the direction indicated by arrows q, the width should preferably be chosen such that $$tS(P-d)/2 \quad (5).$$

The height R' of the tapering surface should preferably be chosen such that $$OR't_0 \quad (6),$$

in view of the geometrical rigidity of the portion between the adjacent cylindrical members, having a length of $(P_0-d_0-2t)$. The deviation of the cross section of the tapering surface perpendicular to the axis of the cylindrical member, from a true circle increases with the increase in the tapering height, but the tapering height is limited by the projections of the shaping die 35'.

As described above, according to this invention, the inner edge of the bottom portion of each cylindrical member is provided with a tapering surface so that an electron lens having a desired circular cross section can be formed. As a result, an electrode structure having its cylindrical portions integrally formed and having a desired focusing characteristic can be obtained. Moreover, with the tapering surfaces provided, the measurement of eccentricity can be facilitated and therefore the process management can be simplified. Further, the integral configuration of the electrode simplifies the process of fabrication and the provision of the tapering surface improves the production yield.

What is claimed is:

1. An electrode structure for an electron gun, having three closely arranged hollow cylindrical members extending in parallel from a base plate having apertures in alignment with respective cylindrical members, the base plate and the cylindrical members being formed integrally, wherein the inner edge of the bottom portion of each of said hollow cylindrical members is provided with a tapering surface having a precise circular cross section which is concentric with the centers of said apertures, whereby there is obtained a predetermined concentricity of said apertures with respect to the axes of said respective cylindrical members.

2. An electrode structure as claimed in claim 1, wherein circular grooves are cut in portions of said base plate, on the opposite sides of said tapering surfaces, around said cylindrical members.

3. An electrode structure as claimed in claim 1, wherein said three cylindrical members are arranged in an in-line configuration.

4. An electrode structure as claimed in claim 3, wherein circular grooves are cut in portions of said base plate, on the opposite sides of said tapering surfaces, around said cylindrical members.

5. An electrode structure as claimed in claim 1, wherein each of said tapering surfaces is flat, concave or convex.

6. An electrode structure as claimed in claim 2, wherein said circular grooves are formed through press shaping by using a die having annular projections.

7. An electrode structure as claimed in claim 4, wherein the width of each of said circular grooves around the outer two of said cylindrical members arranged in the in-line configuration is not uniform along the circumferential direction of said groove.

8. An electrode structure as claimed in claim 4, wherein the depth of each of said circular grooves around the outer two of said cylindrical members arranged in the in-line configuration is not uniform along the circumferential direction of said groove.

9. An electrode structure as claimed in claim 4, wherein said circular grooves are formed by a shaping mold having projections.

10. An electrode for an electron gun for use in a color picture tube, comprising a plurality of box-shaped electrodes each having a bottom portion, three electron-beam-passing apertures provided in said bottom portion, three cylindrical members integral with said bottom portion and extending from the periphery of a respective one of each of said apertures in parallel into a space inside said box-shaped electrode, a plurality of said box-shaped electrodes being arranged such that the bottom portion of each box-shaped electrode faces the bottom portion of another box-shaped electrode thereby to form said electron gun, wherein the opening of the aperture at the root of each cylindrical member has a tapering surface such that the inner diameter of the related aperture is reduced in the direction toward the center thereof along the line of extension of said cylindrical member, whereby there is obtained a predetermined concentricity of said opening at the root of each said cylindrical member with respect to the center of each aperture.

11. An electrode according to claim 10, wherein said tapering surfaces are linear in section.

12. An electrode structure as claimed in claim 10, wherein said three cylindrical members are arranged in an in-line configuration.

13. An electrode structure according to claim 10, wherein circular grooves are provided around each of said cylindrical members in the surface of said bottom portion which is opposite to that having said tapering surfaces.

14. An electrode structure according to claim 13, wherein said three cylindrical electrodes are arranged in an in-line configuration, and wherein the width of each of the circular grooves around the outer two of said cylindrical members is not uniform along the circumferential direction of said groove.

15. An electrode as claimed in claims 13 or 14, wherein the depth of each of said circular grooves around the outer two of said cylindrical members arranged in the in-line configuration is not uniform along the circumferential direction of said groove.

* * * * *

UNITED STATES PATENT AND TRADEMARK OFFICE

CERTIFICATE OF CORRECTION

PATENT NO. : 4,510,413

DATED : April 9, 1985

INVENTOR(S) : Minoru YABE et al

It is certified that error appears in the above—identified patent and that said Letters Patent is hereby corrected as shown below:

On the title page, Item (22) should read:

Filing Date: December 9, 1980

Signed and Sealed this

*First* Day of *October 1985*

[SEAL]

*Attest:*

DONALD J. QUIGG

*Attesting Officer*

*Commissioner of Patents and Trademarks—Designate*